US009790705B2

(12) United States Patent
Lyon

(10) Patent No.: US 9,790,705 B2
(45) Date of Patent: Oct. 17, 2017

(54) COLLAPSIBLE OUTDOOR STRUCTURE

(71) Applicant: Aaron Lyon, Gardner, MA (US)

(72) Inventor: Aaron Lyon, Gardner, MA (US)

( * ) Notice: Subject to any disclaimer, the term of this patent is extended or adjusted under 35 U.S.C. 154(b) by 0 days.

(21) Appl. No.: 15/437,669

(22) Filed: Feb. 21, 2017

(65) Prior Publication Data

US 2017/0241159 A1 Aug. 24, 2017

Related U.S. Application Data

(60) Provisional application No. 62/297,921, filed on Feb. 21, 2016, provisional application No. 62/435,765, filed on Dec. 17, 2016.

(51) Int. Cl.

| | |
|---|---|
| ***E04H 15/48*** | (2006.01) |
| ***E04H 15/26*** | (2006.01) |
| ***E04H 15/28*** | (2006.01) |
| *E04H 15/60* | (2006.01) |
| *E04H 15/54* | (2006.01) |

(52) U.S. Cl.

CPC ..... *E04H 15/48* (2013.01); *E04H 15/26* (2013.01); *E04H 15/28* (2013.01); *E04H 15/54* (2013.01); *E04H 15/60* (2013.01)

(58) Field of Classification Search

CPC ..... E04H 15/24; E04H 15/26; E04H 15/28; E04H 15/48; A45B 2023/0012; A45B 2023/0018; E04B 2001/0092; E04B 1/343; E04B 1/34357; E04B 1/344

See application file for complete search history.

(56) References Cited

U.S. PATENT DOCUMENTS 34,011 A 12/1861 Rankin
108,832 A * 11/1870 Ritchie ..... E04H 15/28 135/118

(Continued)

FOREIGN PATENT DOCUMENTS

DE 102011016701 A1 * 10/2012 ..... E04H 15/36
GB 760960 A * 11/1956 ..... E04H 15/28
WO 2008/120071 A2 10/2008

*Primary Examiner* — David R Dunn
*Assistant Examiner* — Danielle Jackson
(74) *Attorney, Agent, or Firm* — PK Patent Law

(57) ABSTRACT

An internal collapsible frame for use with an outdoor living structure is provided. The internal collapsible frame can include a center tube assembly including a center tube including a top end portion and a bottom end portion. A slidable hub can be slidably arranged on the center tube. The internal collapsible frame can include a plurality of roof tube assemblies each including a first proximal end and a second distal end, each first proximal end being pivotably attached to the top hub. The internal collapsible frame can include a plurality of ceiling tube assemblies each including a first proximal end and a second distal end, each first proximal end being pivotably attached to the sliding hub and each second distal end being attached to an outer corner connection assembly. The internal collapsible frame can include a plurality of hinged strut assemblies each including a first end and a second end and being capable of folding about a hinge, each of the first and second ends of the hinged strut assemblies being attached to a ceiling tube end cap of a respective outer corner connection assembly and being capable of pivoting and rotating with respect to the ceiling tube end cap.

19 Claims, 18 Drawing Sheets

(56) References Cited

U.S. PATENT DOCUMENTS

| | | | | | |
|---|---|---|---|---|---|
| 402,755 | A | | 5/1889 | Lyon | |
| 809,516 | A | * | 1/1906 | Mann | E04H 15/28 135/114 |
| 880,176 | A | | 2/1908 | Swanwick | |
| 1,204,616 | A | | 11/1916 | Upton | |
| 1,449,894 | A | | 3/1923 | Dial | |
| 1,801,913 | A | | 4/1931 | Frederick | |
| 2,530,765 | A | | 11/1950 | Greenup | |
| 3,388,712 | A | * | 6/1968 | Taylor | E04H 15/28 135/15.1 |
| 3,626,958 | A | | 12/1971 | Ross | |
| 4,074,682 | A | * | 2/1978 | Yoon | E04H 15/48 135/135 |
| 5,640,984 | A | * | 6/1997 | Dubunsky | A45B 23/00 135/15.1 |
| 6,250,322 | B1 | * | 6/2001 | Porter | A45B 23/00 135/15.1 |
| 6,779,538 | B2 | | 8/2004 | Morgante et al. | |
| 6,996,941 | B1 | * | 2/2006 | Maschoff | E04H 15/48 135/122 |
| 7,111,633 | B2 | * | 9/2006 | Moroney | E04H 15/28 135/132 |
| 7,350,532 | B2 | | 4/2008 | Wu | |
| 7,703,469 | B2 | | 4/2010 | Danziger | |
| 8,220,477 | B2 | | 7/2012 | Park | |

* cited by examiner 10B
640
620

10C
640
630

642
644
642
642
642

600

610

10D

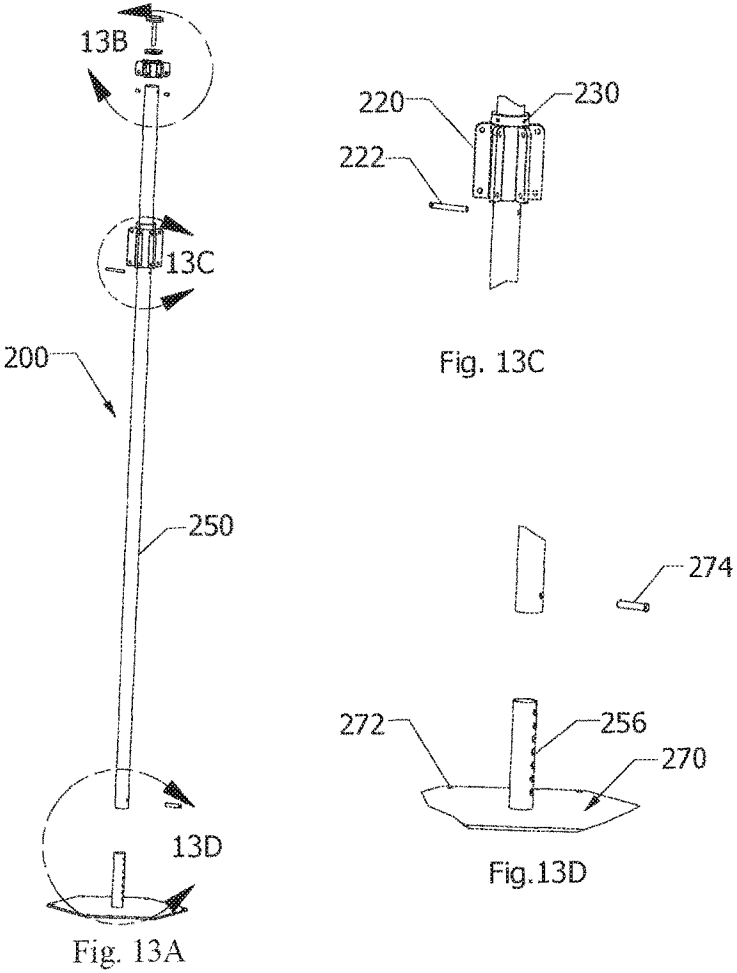
Fig. 13C
Fig.13D
Fig. 13A
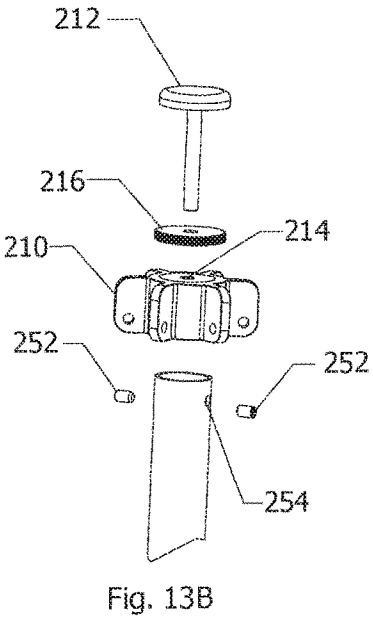
Fig. 13B

COLLAPSIBLE OUTDOOR STRUCTURE

CROSS REFERENCE TO RELATED APPLICATIONS

The present application claims the benefit from earlier filed U.S. Provisional Patent Application No. 62/297,921, filed Feb. 21, 2016, and from earlier filed U.S. Provisional Patent Application No. 62/435,765, filed Dec. 17, 2016, which are both incorporated herein in their entirety by reference.

FIELD OF THE INVENTION

The present teachings relate to a collapsible outdoor structure. In particular, the present teachings relate to an outdoor living structure that includes an internal collapsible frame and a fabric roof and side walls for residential, commercial, and humanitarian uses.

BACKGROUND OF THE INVENTION

Known humanitarian outdoor structures can be categorized as emergency shelters, intermediate shelters, and long-term shelters. Emergency shelters typically include rapid set-up tents or suspended tarps to protect people from the elements within 24 hours. Intermediate term shelters are more robust and are intended to serve as a bridge shelter, up to 12 months, until a long term permanent housing solution can be found. However, known intermediate term shelters require a great deal of time and resources to construct.

Known commercial outdoor structures have frames that require assembly. After frame assembly, a fabric covering is installed over the frame. The frames remain fixed in the location chosen for the structure and complete disassembly is required to relocate. In regions subject to snow, the fabric coverings must be removed each winter because the outdoor structures are unable to support the snow load. The installation and removal of fabric coverings usually requires up to 2 people, or even more. Often, the user will elect to leave the assembled frame erected without the fabric covering until the next season of use. This leaves a skeletal frame that is not very attractive and is itself subject to adverse weather and potential damage.

Known commercial structures include a single layer roof fabric and sidewall screen. In some instances, optional frame components can be installed for attachment of a screen and curtain combination for the sidewall.

Accordingly, there exists a need for an outdoor structure that can be readily set-up and taken down, is fully assembled in a stored state, and is easily transportable. A need also exists for an outdoor structure that a single person can readily open and close in a short period of time.

SUMMARY OF THE INVENTION

The present teachings provide an internal collapsible frame for use with an outdoor living structure. The internal collapsible frame can include a center tube assembly having a center tube including a top end portion and a bottom end portion. A top hub can be fixably attached to the center tube in the vicinity of the top end thereof. A slidable hub can be arranged on the center tube and slidably movable between the top end portion and a bottom end portion. The internal collapsible frame can include a plurality of roof tube assemblies each including a first end and second end, each first end being pivotably attached to the top hub. The internal collapsible frame can include a plurality of ceiling tube assemblies each including a first end and a second end, each first end being pivotably attached to the slidable hub and each second end can be attached to an outer corner connection assembly. The internal collapsible frame can include a plurality of hinged strut assemblies each including a first end and a second end and being capable of folding about a hinge, each of the first and second ends of the hinged strut assemblies can be attached to a ceiling tube end cap of the outer corner connection assembly. The distal end of each roof tube assembly can be attached via a pivot hinge to a ceiling tube assembly in an area between the first end and the second end of the ceiling tube assembly. When the internal collapsible frame is being erected by the application of an upward force to the slidable hub, the distance between neighboring outer second ends of the ceiling tube assemblies increases forcing each of the hinged strut assemblies to unfold until the hinged strut assemblies are all in a straightened state and form a ring around an outer perimeter of the collapsible frame.

The present teachings also provide an internal collapsible frame for use with an outdoor living structure. The internal collapsible frame can include a center tube assembly having a center tube including a top end portion and a bottom end portion. A top hub can be fixably attached to the center tube in the vicinity of the top end thereof. A slidable hub can be arranged on the center tube and slidable movable between the top end portion and a bottom end portion. The internal collapsible frame can include a plurality of ceiling tube assemblies each including a first end and a second end, each first end being pivotably attached to the slidable hub and each second end being attached to an outer corner connection assembly. The internal collapsible frame can include a plurality of hinged strut assemblies each including a first end and a second end and being capable of folding about a hinge, each of the first and second ends of the hinged strut assemblies being attached to a ceiling tube end cap of the outer corner connection assembly. When the internal collapsible frame is being erected by the application of an upward force to the slidable hub and causing the distance between neighboring outer second ends of the ceiling tube assemblies to increase, the ends of the hinged strut assemblies are configured to i) pivot with respect to a top surface of the ceiling tube end cap, and ii) rotate about a central axis of the hinged strut assembly.

The present teachings further provide a collapsible structure including an internal collapsible frame and a fabric roof securable to the internal collapsible frame. The internal collapsible frame can include a center tube assembly including a center tube including a top end portion and a bottom end portion. A top hub can be fixably attached to the center tube in the vicinity of the top end thereof. A slidable hub can be slidably arranged on the center tube. The internal collapsible frame can include a plurality of roof tube assemblies each including a first proximal end and a second distal end, each first proximal end being pivotably attached to the top hub. The internal collapsible frame can include a plurality of ceiling tube assemblies each including a first proximal end and a second distal end, each first proximal end being pivotably attached to the sliding hub and each second distal end being attached to an outer corner connection assembly. The internal collapsible frame can include a plurality of hinged strut assemblies each including a first end and a second end and being capable of folding about a hinge, each of the first and second ends of the hinged strut assemblies being attached to a ceiling tube end cap of a respective outer corner connection assembly and being capable of pivoting and rotating with respect to the ceiling tube end cap.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

BRIEF DESCRIPTION OF THE DRAWINGS

FIG. 13A shows a perspective view of the center pipe assembly of the internal collapsible frame;

FIG. 13B shows a blown-up view of the top hub of detail '13B' of FIG. 13A;

FIG. 13C shows a blown-up view of the sliding hub of detail '13C' of FIG. 13A;

FIG. 13D shows a blown-up view of the center base tube of detail '13D' of FIG. 13A;

Figure 1:
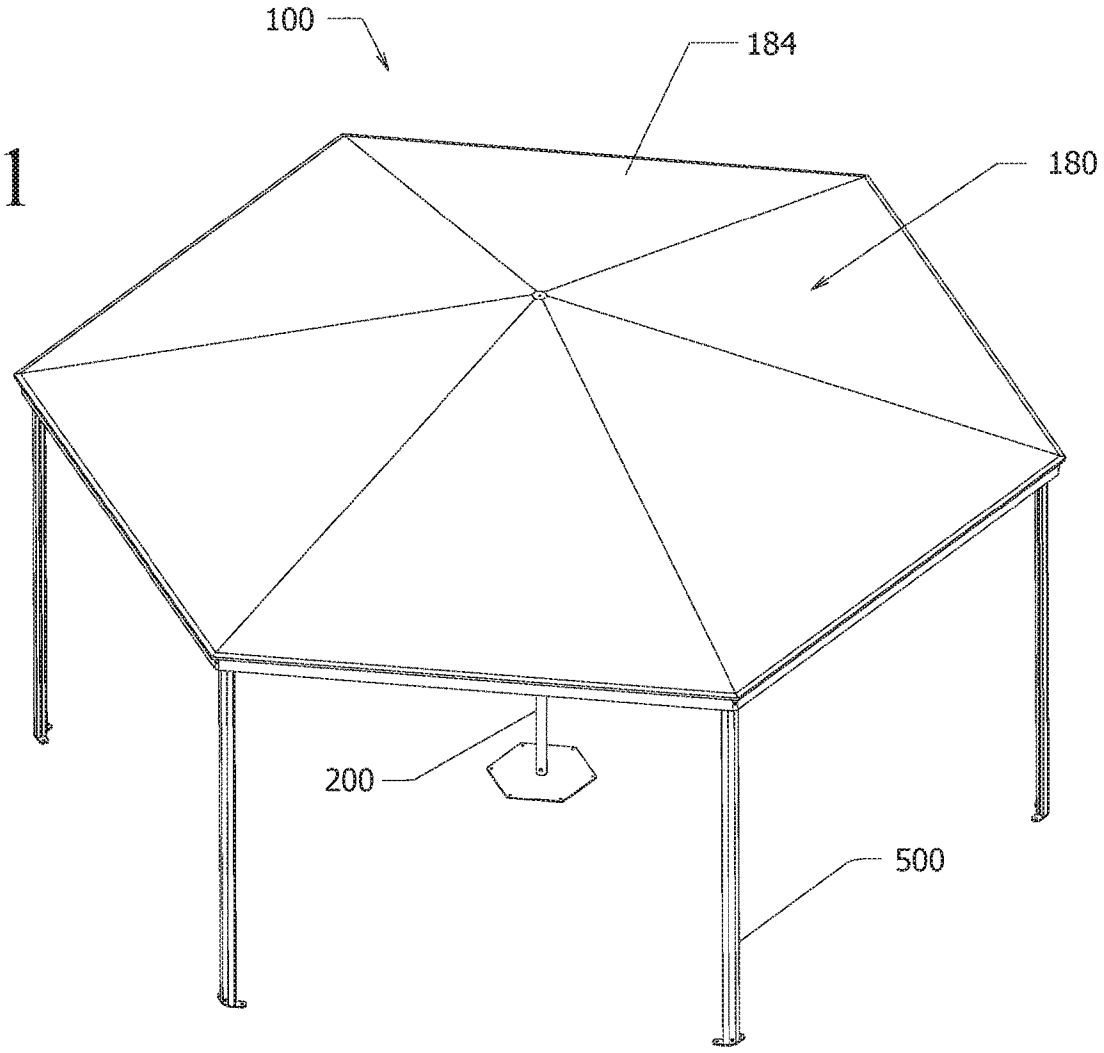
FIG. 1 shows a perspective view of the collapsible outdoor living structure of the present teachings in an erected, non-collapsed state.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

Referring initially to FIGS. 1, 2, 3A, 4, and 5A, a collapsible outdoor living structure 100 of the present teachings can include an internal collapsible frame 140 onto which a fabric roof 180, as well as optional sidewalls and interior screening can be detachably secured. As best shown in FIG. 3, the internal collapsible frame 140 can be manually actuated (i.e. erected or collapsed) by applying force, upward or downward, to a sliding hub 220 mounted about a center tube assembly 200. The internal collapsible frame 140 can include a plurality of roof tube assemblies 300 that can be connected to a top hub 210 that is mounted on a top portion of the center tube assembly 200. The internal collapsible frame 140 can include a plurality of ceiling tube assemblies 400 that can be connected to the sliding hub 220 which can slide freely up or down along the axis of the center tube assembly 200. Each of the roof tube assemblies 300 can be connected to a respective ceiling tube assembly 400 via a pivot hinge connection 410.

When the internal collapsible frame 140 is fully erected, a plurality of hinged strut assemblies 600 form a ring around the entire outer perimeter of the collapsible frame 140. Each of the ends of the hinged strut assemblies 600 can be connected to respective outer corner connection assemblies 420. Attached to the outer ends of each of the ceiling tube assemblies 400 can be leg tube assemblies 500 that are allowed to pivot so that when the internal collapsible frame 140 is in a collapsed state, the roof tube assemblies 300, ceiling tube assemblies 400, leg tube assemblies 500, and hinged strut assemblies 600 fold and rest in close proximity to the center tube assembly 200, as shown in FIG. 5A.

When a user erects the outdoor living structure 100 by moving the sliding hub 220 upwardly along the center tube assembly 200, the design of the internal collapsible frame 140 allows the creation of a gravity assist as will be described in more detail below.

Figure 4:
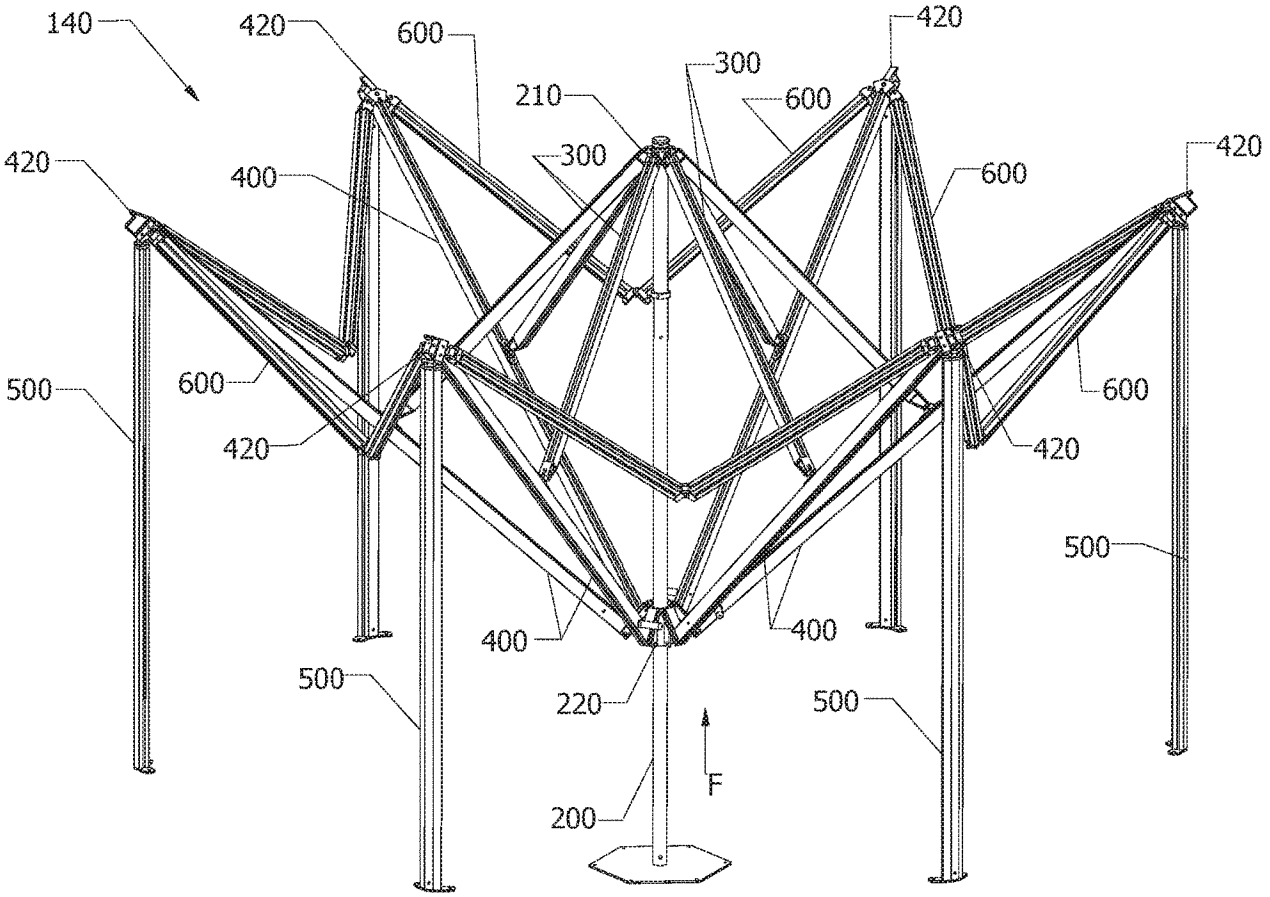
FIG. 4 shows a perspective view of the internal collapsible frame of FIG. 3A in the process of being erected.

Referring to FIG. 4, when an upward force, F, is directly or indirectly applied to the sliding hub 220, the ceiling tube assemblies 400 apply a load to the roof tube assemblies 300 via the pivot hinge connections 410 and force the ceiling tube assemblies 400 and roof tube assemblies 300 to extend radially outwardly from the center tube assembly 200. As the roof tube assemblies 300 and the ceiling tube assemblies 400 extend outwardly, gravity causes the leg tube assemblies 500 to pivot via ceiling tube end caps 480 of outer corner connection assemblies 420 so that the leg tube assemblies 500 remain substantially parallel (i.e. vertically aligned) in relation to the axis of the center tube assembly 200.

When the internal collapsible frame 140 is fully erected, the plurality of hinged strut assemblies 600 form a ring around the entire outer perimeter of the collapsible frame 140. Each of the ends of the hinged strut assemblies 600 can be connected to respective outer corner connection assemblies 420. As shown in FIG. 5A, when the internal collapsible frame 140 is at rest in a closed or collapsed state, the plurality of hinged strut assemblies 600 fold and lay at rest between each of the ceiling tube assemblies 400. Later, when the internal collapsible frame 140 is being erected, the distance between neighboring outer ends of the ceiling tube assemblies 400 increases. As this distance increases, each of the hinged strut assemblies 600 begin to unfold until the hinged strut assemblies 600 are all in a straightened state. When the internal collapsible frame 140 is fully erected, central hinge assemblies 630 of the hinged strut assemblies 600 can be locked via the insertion of a lock pin 618 into the hinged joint as discussed below with reference to FIG. 12. By way of the outer corner connection assemblies 420, as the internal collapsible frame 140 is being erected the ends of the hinged strut assemblies 600 are designed to i) pivot approximately 60 degrees along the same plane as a top surface of the ceiling tube end cap 480 (discussed in more below), and ii) rotate about 30 degrees about the central axis of strut end hinge assemblies 610, 620 (also discussed in more detail below).

Figures 10A, 10B, 10C, 10D, 10E:
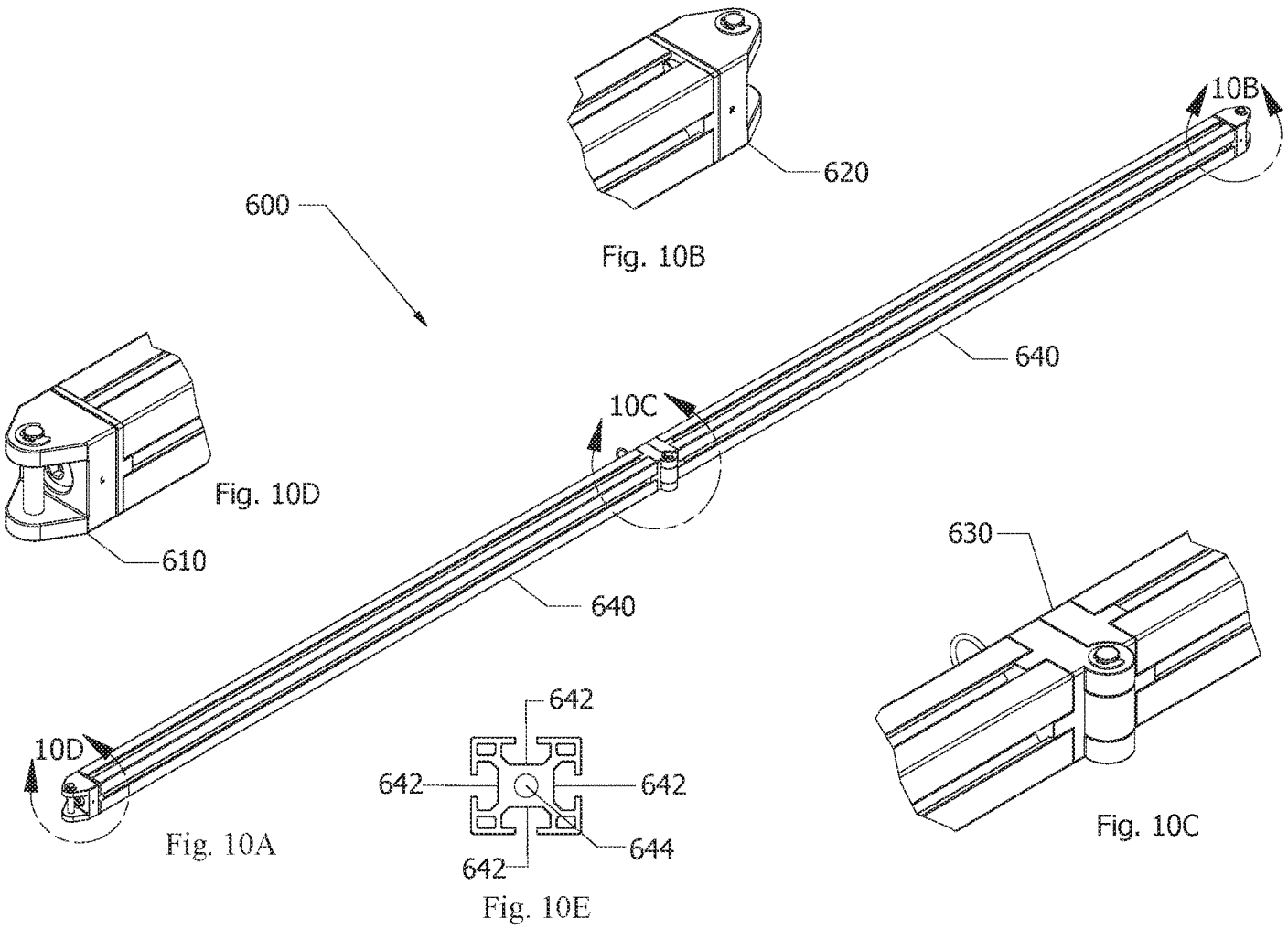
FIG. 10A shows a perspective view of a strut tube assembly of the internal collapsible frame.
FIG. 10B shows a blown-up view of left end hinge assembly of detail '10B' of FIG. 10A.
FIG. 10C shows a blown-up view of central hinge assembly of detail '10C' of FIG. 10A.
FIG. 10D shows a blown-up view of right end hinge assembly of detail '10D' of FIG. 10A.
FIG. 10E shows a cross-section through the strut tube of FIG. 10A.

As shown in FIG. 10E, the hinged strut assemblies 600 can include extruded tubes having t-slots 642 on each exterior face. The t-slots 642 can include fabric attachment slots that can incorporate common fabric rollers or slides, or can be used with t-slot nuts to attach accessories to each exterior face of the assembled hinged strut assembly 600. When the t-slots 642 are used as fabric tracks, curtains and screening can be attached to and can slide along each strut tube segment 640 so the user can readily open or close wall fabrics and screening.

The fabric roof 180 can be made as a single unit including sewn sections of material, or can be divided into two sections of overlapping sewn fabric stitched together along seams in a manner that allows air to pass between the two overlapping sections to reduce internal pressure. Fabric side wall materials of the collapsible outdoor living structure 100 can include an inner and outer curtain, an internal screening, or additional fabric layer. The internal collapsible frame 140 is designed to allow the roof and side wall fabrics and screening to remain attached to the internal collapsible frame 410 and to naturally fold in an orderly fashion about the components of the frame 410 as it is being collapsed.

The collapsible outdoor living structure 100 of the present teachings simplifies seasonal set-ups and take downs by providing a fully assembled, transportable, and collapsible structure that can be collapsed into a narrow column, such as a hexagonal column. This allows a single person to open or close the collapsible outdoor living structure 100 in a very short period of time. When the collapsible outdoor living structure 100 is collapsed, a cover can be placed over the hexagonal column to protect the collapsible frame 140 and the attached fabric from the elements. The fully assembled collapsible outdoor living structure 100 can be readily moved from one location to another without disassembly.

Figure 2:
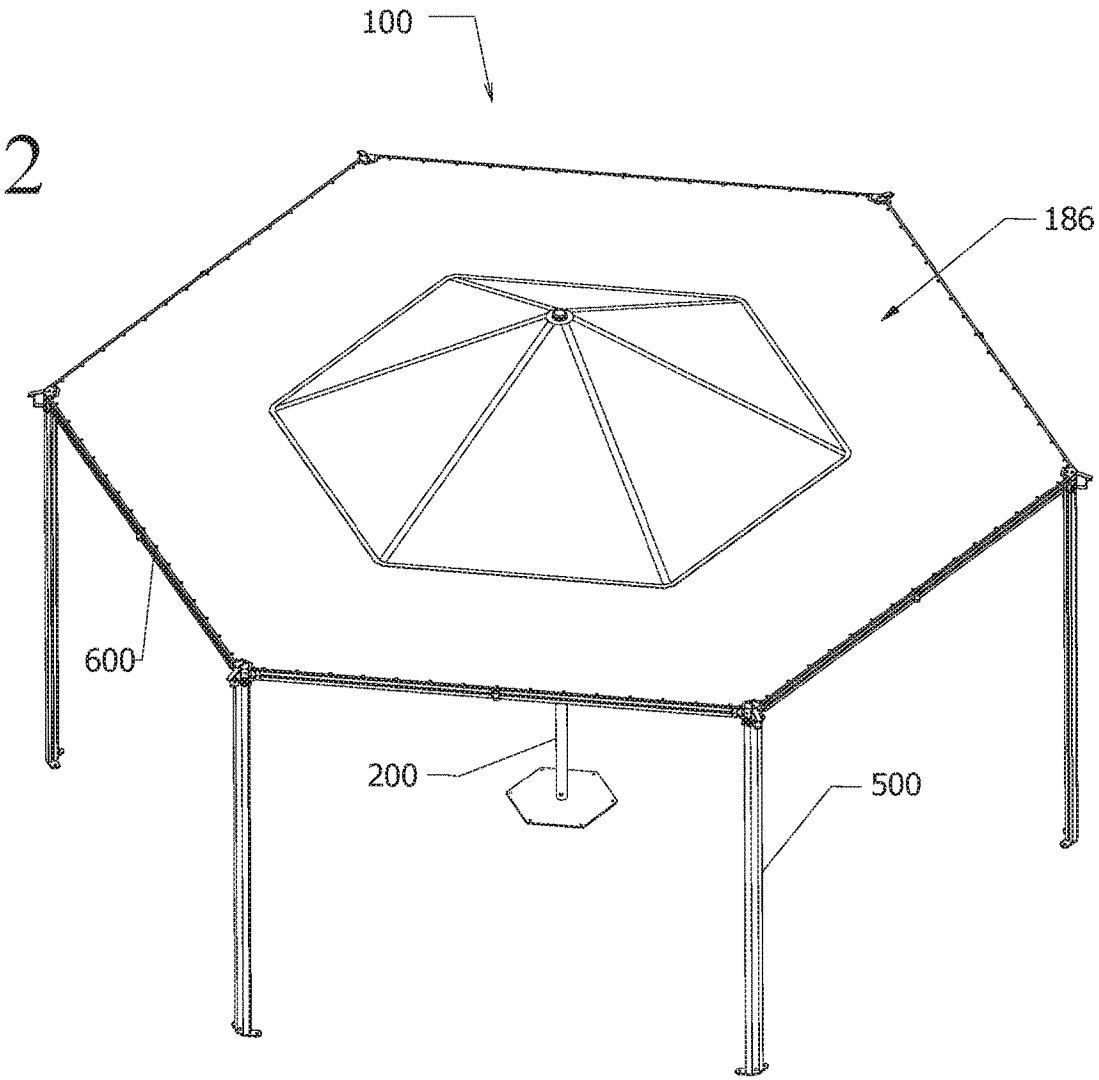
FIG. 2 shows a perspective view of the collapsible outdoor living structure of FIG. 1 with the fabric roof cap removed.
Figures 3A, 3B, 3C, 3D:
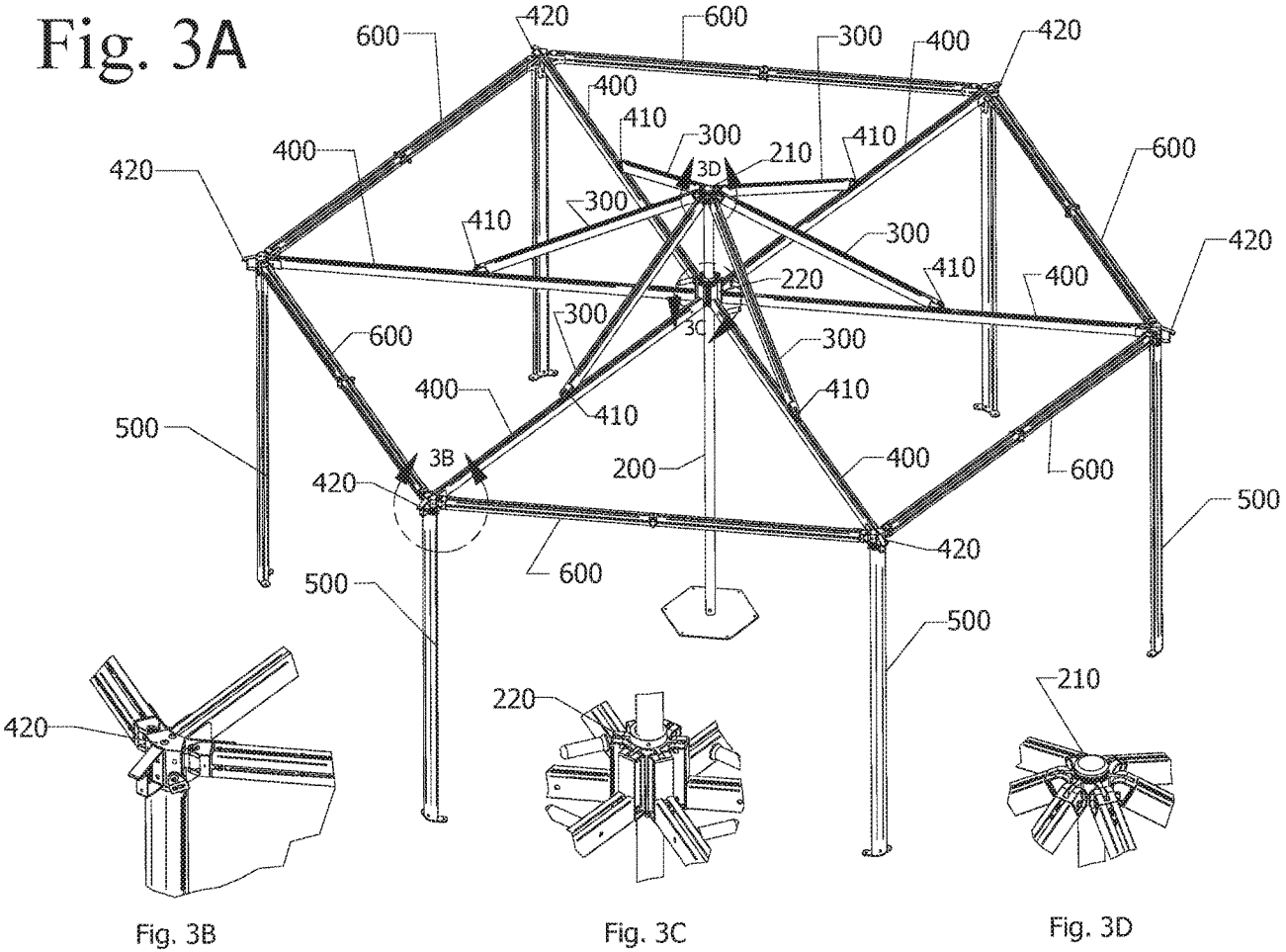
FIG. 3A shows a perspective view of the collapsible outdoor living structure of FIG. 1 with the fabric removed and showing the internal collapsible frame.
FIG. 3B shows a blown-up perspective view of outer corner connection assembly of detail '3B' of FIG. 3A.
FIG. 3C shows a blown-up perspective view of the sliding hub assembly of detail '3C' of FIG. 3A.
FIG. 3D shows a blown-up perspective view of the top hub assembly of detail '3D' of FIG. 3A.

FIG. 1 shows the collapsible outdoor living structure 100 of the present teachings in an erected (i.e. non-collapsed) state with the fabric roof 180 including a fabric roof cap 184 being arranged on the internal collapsible frame 140. FIG. 2 also shows the collapsible outdoor living structure 100 of FIG. 1 with the fabric roof cap 184 removed and showing a fabric inner ceiling 186 attached to the internal collapsible frame 140. The fabric inner ceiling 186 can be attached around the perimeter of the internal collapsible frame 140 at the hinged strut assemblies 600 and can also be attached to the ceiling tube assemblies 400 and the roof tube assemblies 300.

Figure 5C:
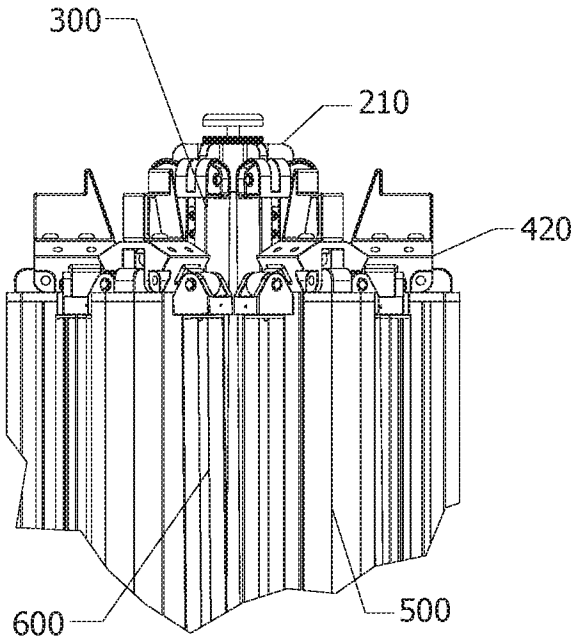
FIG. 5C shows a blown-up view of a top portion of internal collapsible frame of detail '5C' of FIG. 5A.
Figure 5A:
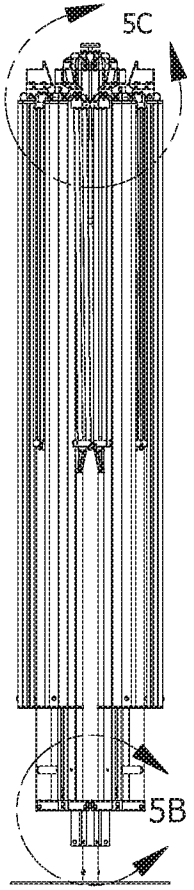
FIG. 5A shows a side view of the internal collapsible frame in a collapsed state.
Figure 5B:
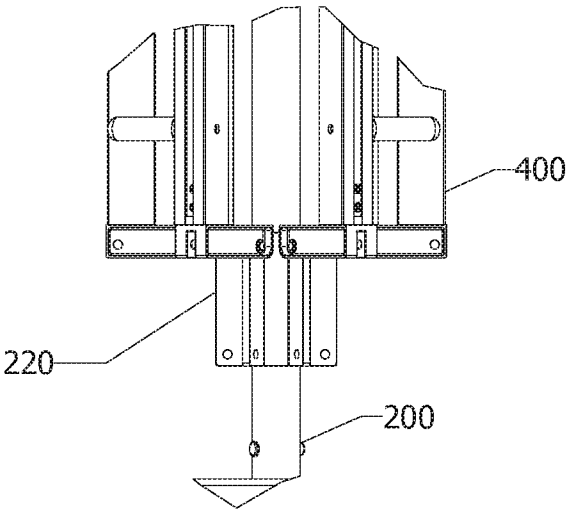
FIG. 5B shows a blown-up view of a bottom portion of internal collapsible frame of detail '5B' of FIG. 5A.

Referring now to FIGS. 5A, 5B, and 5C, the internal collapsible frame 140 is shown in a collapsed state where the roof tube assemblies 300, ceiling tube assemblies 400, and leg tube assemblies 500 are all folded and extend parallel to the axis of the center tube assembly 200 in a manner that leaves a sufficient gap to allow space for fabric to remain attached to the internal collapsible frame 140. The hinged strut assemblies 600 are folded and resting about the ceiling tube assemblies 400.

Figures 6A, 6B, 6C:
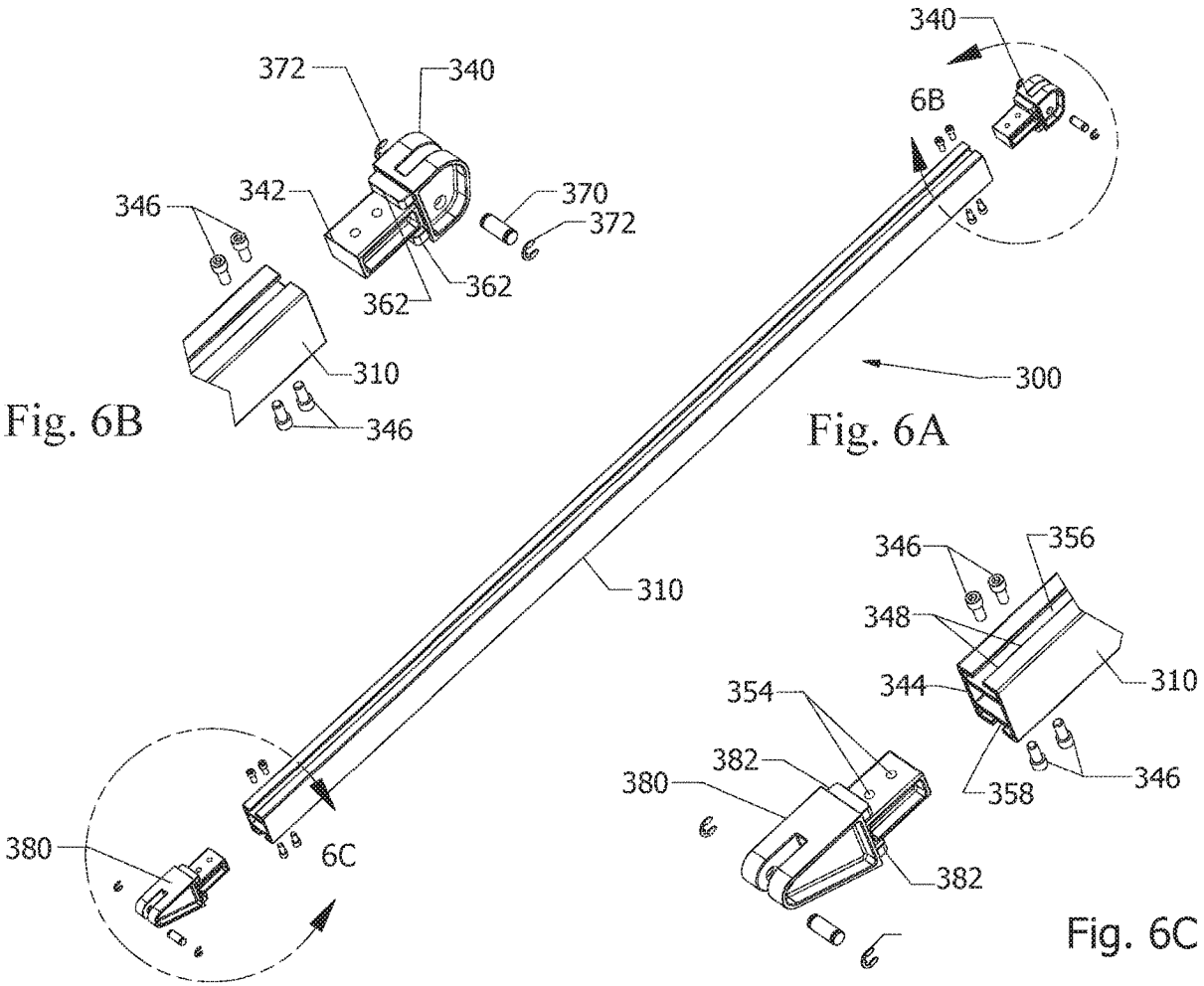
FIG. 6A shows a perspective view of a roof tube assembly of the internal collapsible frame.
FIG. 6B shows a exploded view of the top hub connector of detail '6B' of FIG. 6A.
FIG. 6C shows a exploded view of the roof pivot connector of detail '6C' of FIG. 6A.

Referring now to FIGS. 6A, 6B, and 6C, each roof tube assembly 300 can be made up of a roof tube 310 having a top hub connector 340 attached at one end thereof and a roof pivot connector 380 attached at the opposite end thereof. A top hub connector mount stem 342 can be inserted into an inner channel 344 of the roof tube 310 and can be fastened to the roof tube 310 by mating bolts 346. The roof pivot connector 380 can be inserted into roof tube 310 and fastened with mating bolts 346. The extruded roof tube 310 can include an upper t-slot 356 and a lower t-slot 358. The top hub connector 340 can include stabilizer tabs 362 that are designed to engage the upper t-slot 356 and the lower t-slot 358 after insertion into roof tube 310. The roof pivot connector 380 can also include stabilizer tabs 382 similar to the top hub connector 340.

Figures 7A, 7B, 7C:
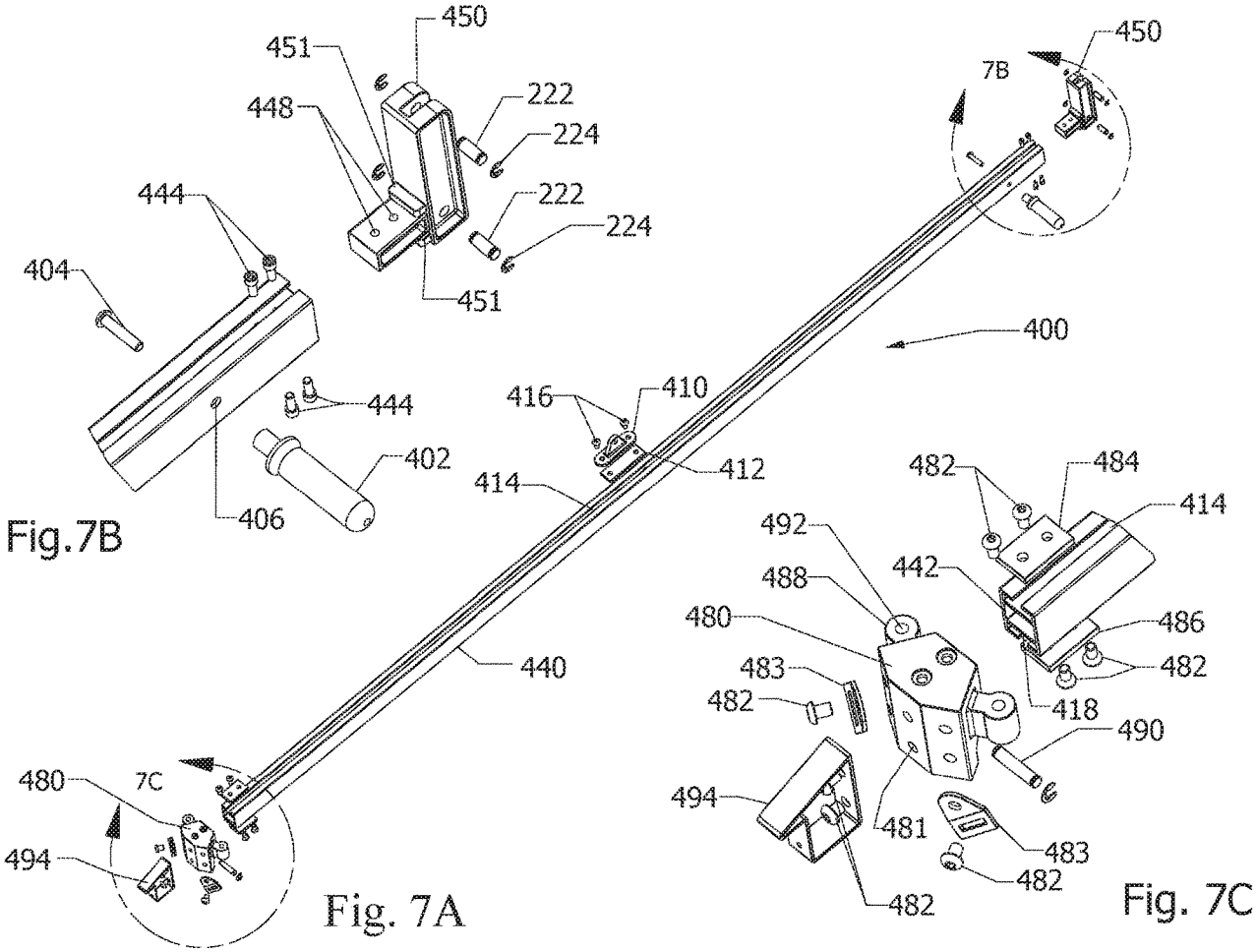
FIG. 7A shows a perspective view of a ceiling tube assembly of the internal collapsible frame.
FIG. 7B shows a exploded view of the sliding hub connector of detail '7B' of FIG. 7A.
FIG. 7C shows a exploded view of the ceiling tab end cap of detail '7C' of FIG. 7A.

Referring now to FIGS. 7A, 7B, and 7C, each ceiling tube assembly 400 can include a ceiling tube 440, a sliding hub connector 450, roof pivot connector hinge 410, a ceiling tube end cap 480, and a soffit bracket 494. The sliding hub connector 450 can be inserted into a ceiling tube inner channel 442 and can be fastened with mating bolts 444. The sliding hub connector 450 can include stabilizer tabs 451 that can engage upper t-slot 414 and lower t-slot 418. The roof pivot connection hinge 410 can be attached to a t-slot nut 412 which can be inserted into an upper t-slot 414 of ceiling tube 440 and fastened with bolts 416. The ceiling tube end cap 480 can be attached to ceiling tube 440 via bolts 482 passing through top of ceiling tube end cap 480 and into upper t-slot nut 484 positioned within upper t-slot 414. Two lower bolts 482 are inserted through ceiling tube end cap 480 and into a lower t-slot nut 486 positioned within a lower t-slot 418. The ceiling tube end cap 480 can include two strut attachment protrusions 488 formed with thru holes 492. A lower face of the ceiling tube end cap 480 can include a thru hole to receive a leg connector pin 490. Attached to an outer face of the ceiling tube end cap 480 can be a soffit bracket 494 fastened with two bolts 482. Structure anchor connectors 483 can be attached to ceiling tube end cap 480 via bolts 482. As shown in FIG. 7B, on a minimum of two adjacent ceiling tube assemblies 400, a lift handle 402 can be attached via a lift handle bolt 404 inserted through ceiling tube thru-hole 406. A pair of lift handles 402 can be attached on opposite sides of two adjacent ceiling tubes 440 selected for lift handle attachment to prevent interference between neighboring lift handles 402.

Figure 8A:
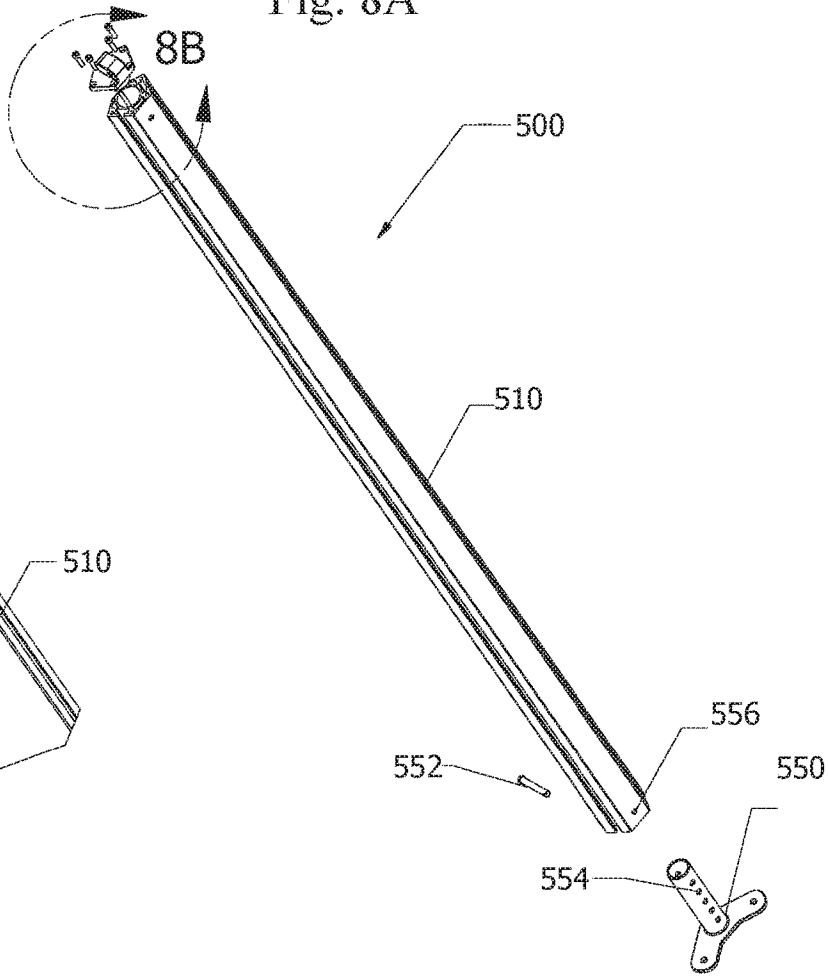
FIG. 8A shows a perspective view of a leg tube assembly of the internal collapsible frame.
Figure 8B:
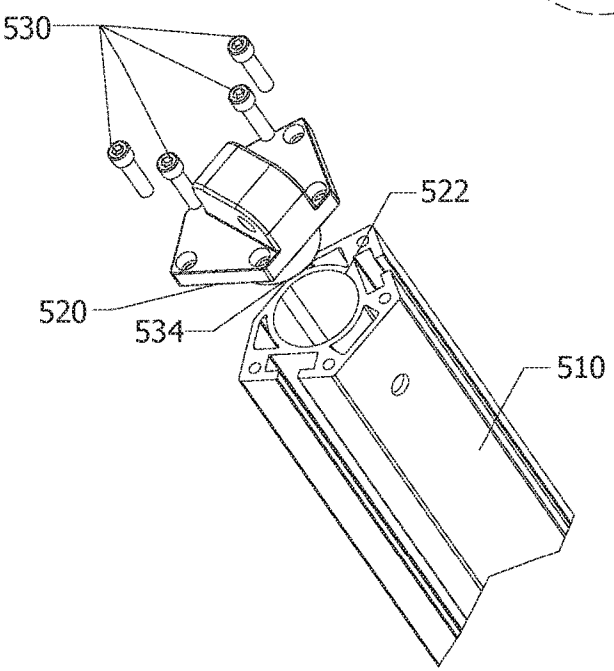
FIG. 8B shows a exploded view of the leg end cap of detail '8B' of FIG. 8A.

Referring now to FIGS. 8A and 8B, each leg tube assembly 500 can include a leg tube 510, a leg end cap 520, and a leg base 550. A leg end cap stem 534 of the leg end cap 520 can be inserted into a leg tube inner channel 522 and fastened with mating bolts 530. The leg base 550 can be adjustably positioned as needed and is connected to leg tube 510 with a leg base connector pin 552 that can be passed through selected leg base adjustment holes 554 on the leg base 550 and a leg tube thru-hole 556 on the leg tube 510.

Figure 9:
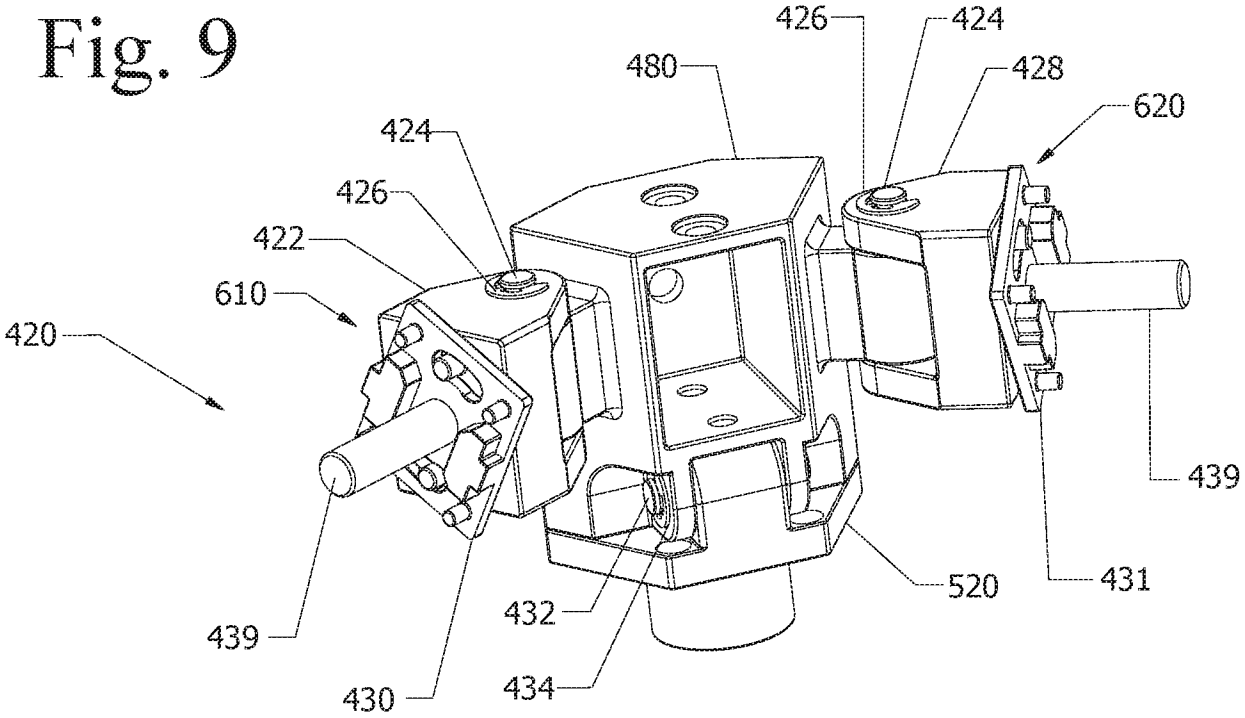
FIG. 9 shows a perspective view of an outer corner connection assembly of the internal collapsible frame.

Referring now to FIG. 9, an outer corner connection assembly 420 including a ceiling tube end cap 480 is shown. The outer corner connection assembly 420 can include a left end hinge assembly 610 and a right end hinge assembly 620. The left end hinge assembly 610 can include a left strut end connector 422 that can be secured to the ceiling tube end cap 480 via a pin 424 and pin clips 426. The right end hinge assembly 620 can include a right strut end connector 428 that can be secured on the opposite side of ceiling tube end cap 480 via a pin 424 and pin clips 426. Universal strut end caps 430, 431 can rest on the flat surface of each of the strut end connectors 422, 428 and are allowed to rotate about central lock bolts 439 that are used to connect the outer corner connection assembly 420 to respective hinged strut assemblies 600, shown on FIG. 10. A leg tube end cap 520 can be pivotally attached to the ceiling tube end cap 480 via a pin 432 and pin clips 434. As previously discussed above, by way of the outer corner connection assemblies 420, as the internal collapsible frame 140 is being erected the ends of hinged strut assemblies 600 are designed to i) pivot up to about 60 degrees along the same plane as the top surface of the ceiling tube end cap 480 of the outer corner connection assembly 420, and ii) rotate up to about 30 degrees about the central axis of the strut end hinged connection assemblies 610, 620. It is noted that the central axis of the strut end hinged connection assemblies 610, 620 is coaxial with a central axis of the strut tubes 640 of the hinged strut assemblies 600 when they are in a straightened state.

Referring now to FIGS. 10A-10E, each hinged strut assembly 600 can include a left end hinge assembly 610, a right end hinge assembly 620, and a central hinge assembly 630. Each hinged strut assembly 600 can include a pair of strut tubes 640. As shown in FIG. 10E, each of the strut tubes 640 can include four t-slots 642 and a central hole 644 tapped on each end to receive lock bolts 646, 439 for attachment to the central hinge assembly 630 and the left and right end hinge assemblies 610, 620.

Figures 11A, 11B:
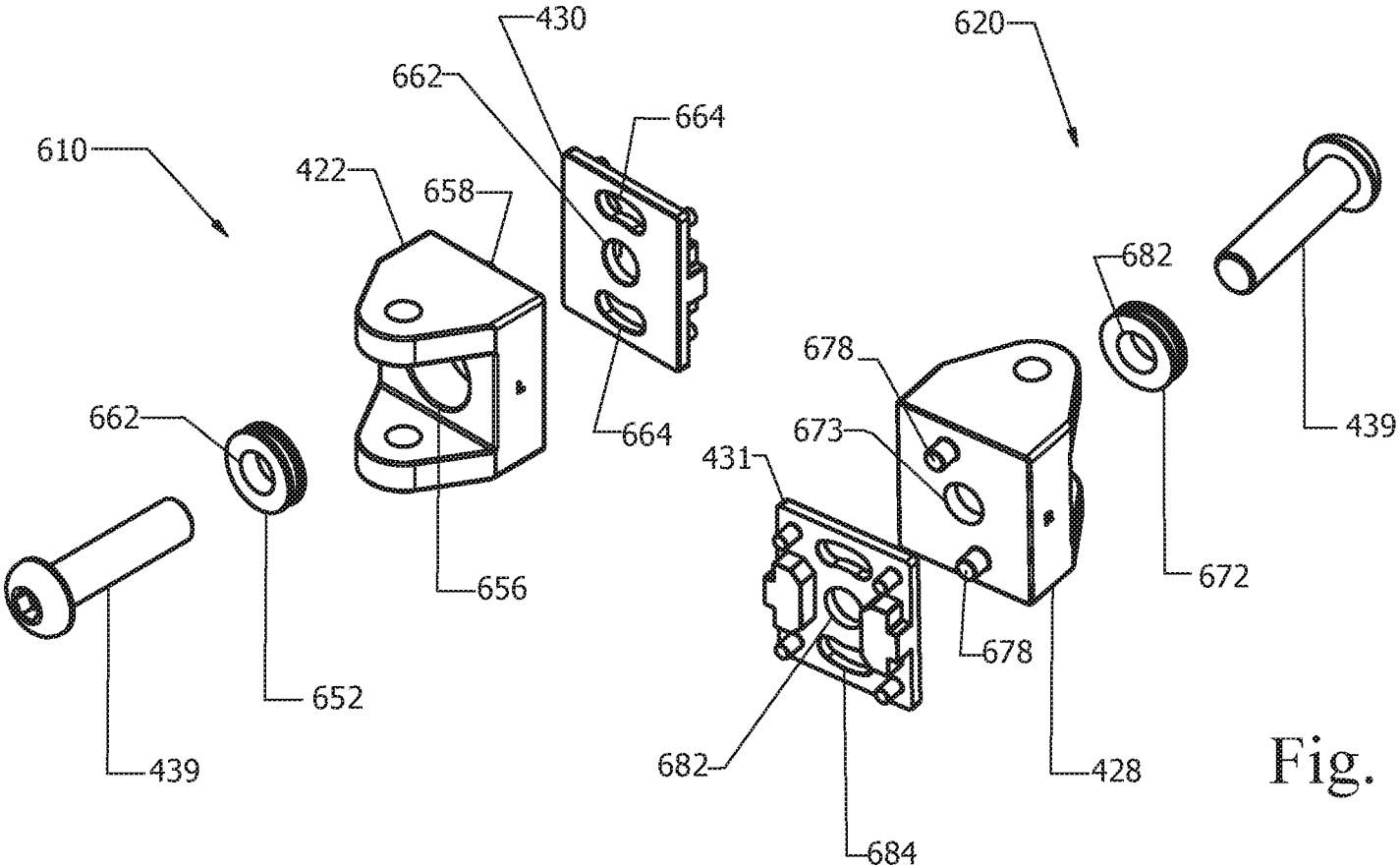
FIG. 11A shows an exploded view of left strut end connector of the internal collapsible frame.
FIG. 11B shows an exploded view of right strut end connector of the internal collapsible frame.

Referring now to FIGS. 11A and 11B, the left end hinge assembly 610 can include the left strut end connector 422, a universal strut end cap 430, a thrust bearing 652, and a central lock bolt 439. The thrust bearing 652 fits into a cavity on left strut end connector 422. The central lock bolt 439 is inserted through a center hole 662 on thrust bearing 652, through center hole 656 on left strut end connector 422, through center hole 662 on universal strut end cap 430, and is threaded into center hole 644 on strut tube 640, as shown on FIG. 10. The left strut end connector 422 can include two dowel pins 658 that can engage with slots 664 on universal strut end cap 430. The slots 664 limit the degree of rotation of the hinged strut assembly 600 and the direction of the rotation. The upper plane of the hinged strut assembly 600 must be allowed to rotate 30 degrees inward to reduce stress on central hinge assembly 630 when the internal collapsible frame 140 is being collapsed.

Referring to FIG. 11B, the right end hinge assembly 620 can include a right strut end connector 428, a universal strut end cap 431, a thrust bearing 672, and a central lock bolt 439. The thrust bearing 672 fits into a cavity on right strut end connector 472. The central lock bolt 439 is inserted through a thrust bearing center hole 682 on thrust bearing 672, through right end hinge center hole 673, through the center hole 682 on universal strut end cap 431, and threaded into strut center hole 644 on strut tube 640, as shown in FIG. 10. The right strut end connector 428 can include two dowel pins 678 that can engage the universal end cap slots 684 in the same manner as the left end hinge assembly 610, however, the dowel pin 678 placement on the right end hinge assembly 620 is opposite of the dowel pin 658 placement on the left end hinge assembly 610 in order for the upper plane of the hinged strut assembly 600 to rotate inward 30 degrees.

Figure 12:
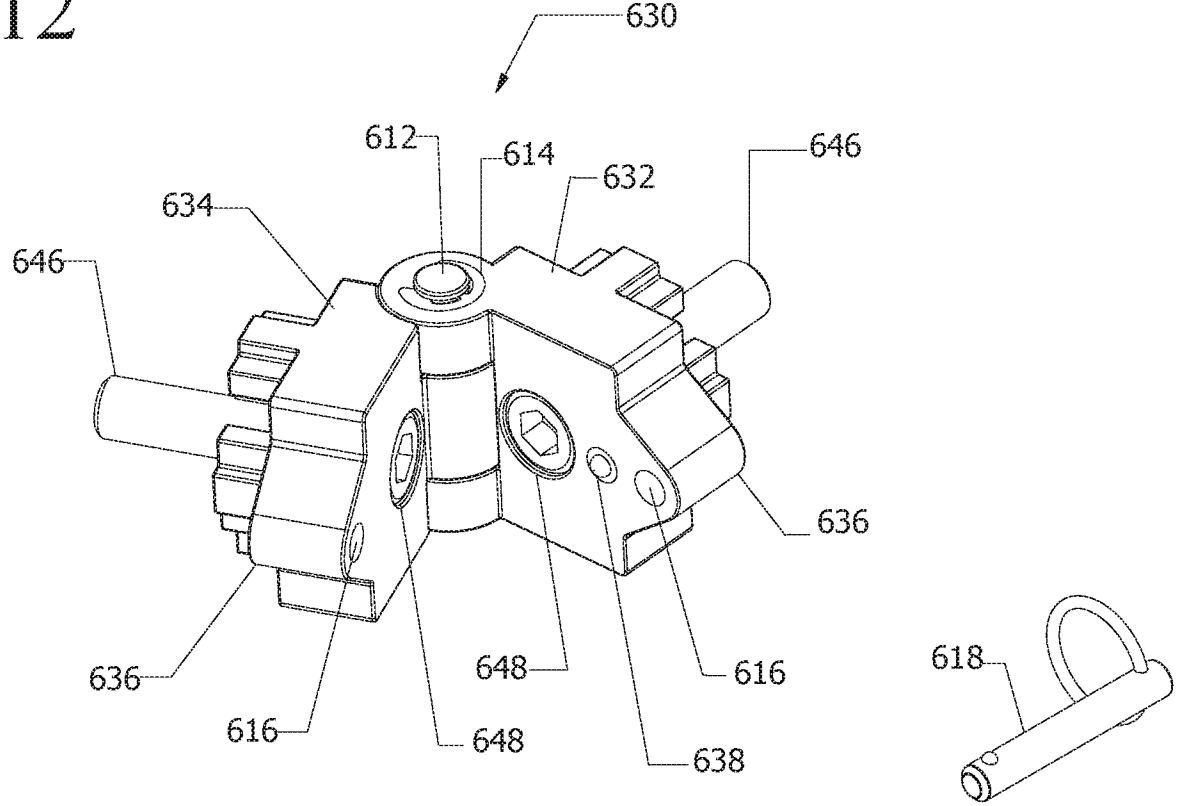
FIG. 12 shows a center hinge assembly of the strut tube assembly of FIGS. 10A and 10C.

Referring now to FIG. 12, a center hinge assembly 630 for a hinged strut assembly 600 can include a female hinge half 632 and a male hinge half 634 connected via a pin 612 and pin clips 614. Both hinge halves 632, 634 can include a lock pin protrusion 636 including a lock pin thru hole 616 to accommodate a lock pin 618. The lock pin 618 can be inserted when the internal collapsible frame 140 is erected and then later removed prior to the frame 140 being collapsed. Female hinge half 632 can include an embedded spring plunger 638 that can apply force to open the hinged assembly 630 and to aide in strut collapse during the take down of the frame 140. The strut hinge halves 632, 634 can be fastened to ends of strut tubes 640 through the use of lock bolts 646 and the central hole 644 formed in the strut tubes 640, shown on FIG. 9. The heads of the lock bolt 646 can be arranged to securely fit into cavities 648 formed on each hinge half 632, 634.

Referring now to FIGS. 13A-13D, the center tube assembly 200 can include a top hub 210, a sliding hub 220, a sliding hub stop ring 230, a center tube 250, and a center tube base 270. The top hub 210 can include a fabric tensioner 212 that threads into a threaded hole 214 formed on top hub 210. The fabric tensioner 212 can be threaded up or down to increase or decrease the tension on the fabric roof cap 184. A lock nut 216 can be used to lock the fabric tensioner 212 in place once a desired fabric tension is achieved. The top hub 210 can be attached to the center tube 250 via bolts 252 that can be inserted through the top hub 210 and into center pipe 250 through bores 254. The sliding hub 220 can be free to slide along the axis of the center tube 250 between sliding hub stop ring 230 and the center tube base 270. After the internal collapsible frame 140 is erected, a safety pin 222 can be inserted through a bore in the center tube 250 to limit vertical movement of the sliding hub 220. The center tube base 270 can include mounting holes 272 formed thereon to allow securement of the center tube base 270 to the ground or various platforms or structures. The center tube base 270 can include adjustment holes 256 to allow height adjustment of the center tube 250. Center tube base 270 can be connected to the center tube 250 via a locking pin 274 that passes through the adjustment holes 256.

Figure 14:
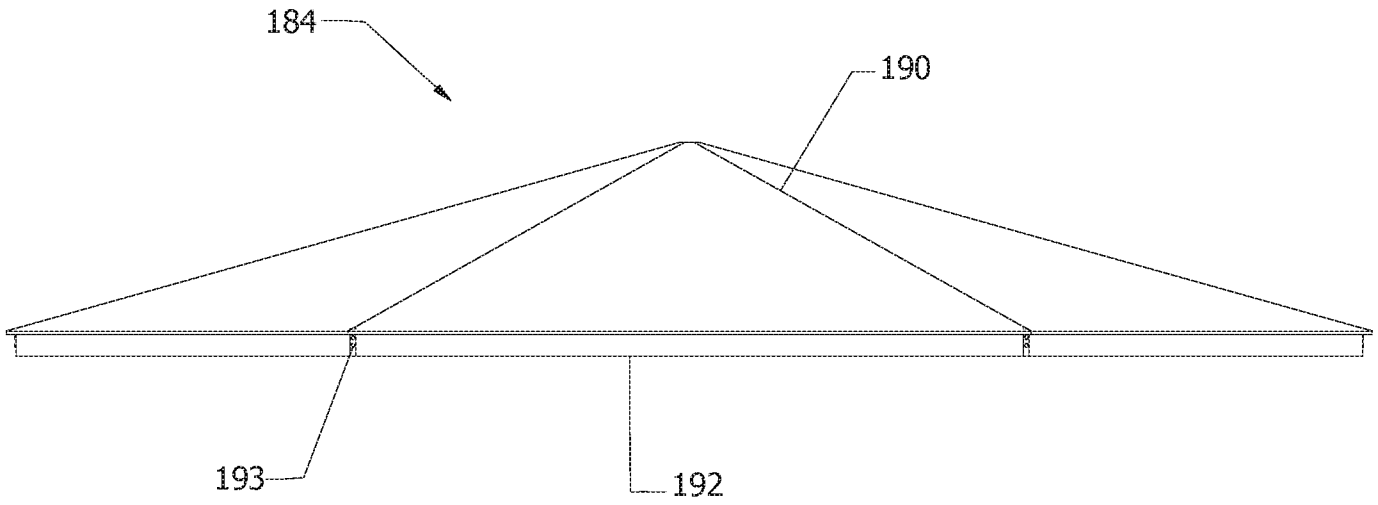
FIG. 14 shows a side view of the fabric roof cap of the collapsible outdoor living structure of FIG. 1.

Referring now to FIG. 14, the fabric roof cap 184 can be made of a variety of outdoor fabrics sewn together in segments at seams 190. Each seam 190 of the fabric roof cap 184 can be full flat felled. The fabric roof cap 184 can include a fabric soffit facia 192. Each corner of the fabric roof cap 184 can include button snaps 193 that can attach to soffit bracket 494, shown in FIG. 7C.

Figure 15:
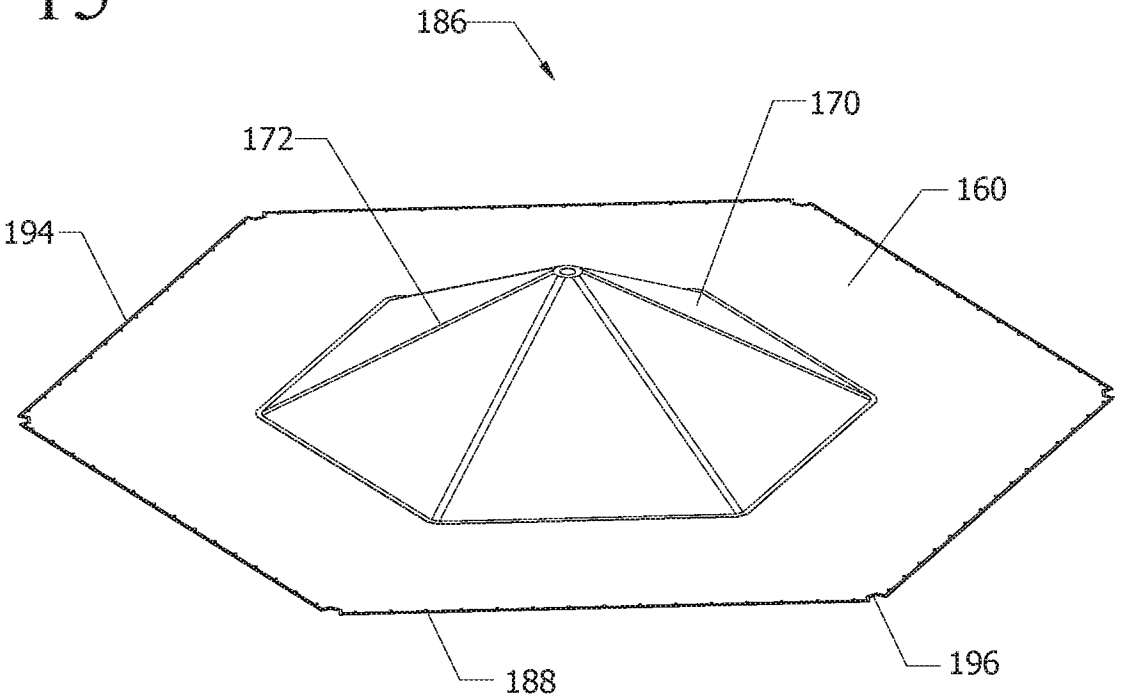
FIG. 15 shows a perspective view of the fabric inner ceiling of the collapsible outdoor living structure of FIG. 1.

Referring now to FIG. 15, the fabric inner ceiling 186 can include a fabric center portion 170 that can be attached to a fabric perimeter portion 160. The fabric center portion 170 can be a watertight fabric or screening that can be sewn together in segments at seams 172. Each fabric center seam 172 can be full flat felled. The fabric inner ceiling 186 can be secured to hinged strut assemblies 600, ceiling tube assemblies 400, and the roof tube assemblies 300 via button snaps 188 that are positioned in t-slot features of these assemblies. The outer edge of the fabric inner ceiling 186 can include double folded seams 194 and a ceiling tube end connector notch 196 to accommodate the ceiling tube end cap 480, shown in FIGS. 7A and 7C.

Figure 16:
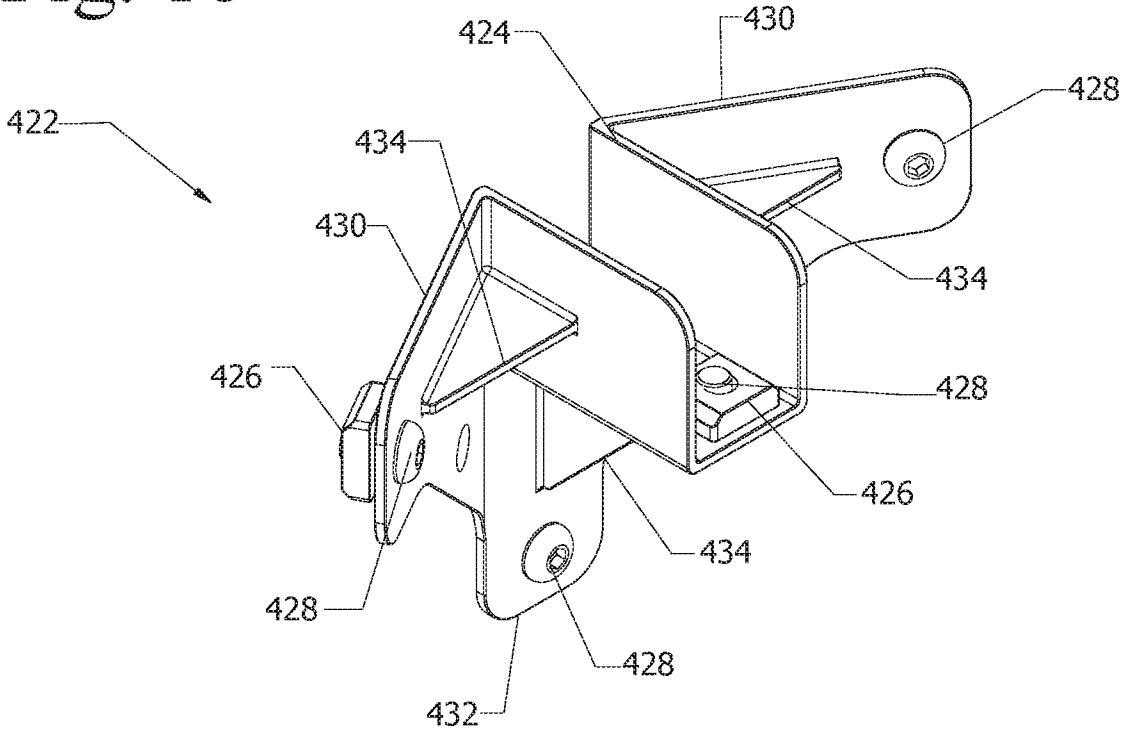
FIG. 16 shows a perspective view of the 3-way cross brace assembly of the internal collapsible frame.

Referring now to FIG. 16, there is shown a perspective view of a 3-way cross brace assembly 422 that can be arranged at the ceiling tube end cap 480 of FIGS. 7A and 7C. The 3-way cross brace assembly 422 can include a channel 424 that can accommodate an end of the ceiling tube 440. The 3-way cross brace assembly 422 can secure to a hinged strut assembly 600, shown on FIG. 10, via t-slot nuts 426 inserted into t-slots 642 formed in strut tube 640, as shown on FIG. 10, and fastened with bolts 428. The 3-way cross brace assembly 422 can include two flat planes 430 that can rest against strut tubes 640 and a lower flat plate 432 that can abut leg tube 510, shown on FIG. 8. The cross brace assembly 422 can include gussets 434 to provide additional stiffness.

Figure 17:
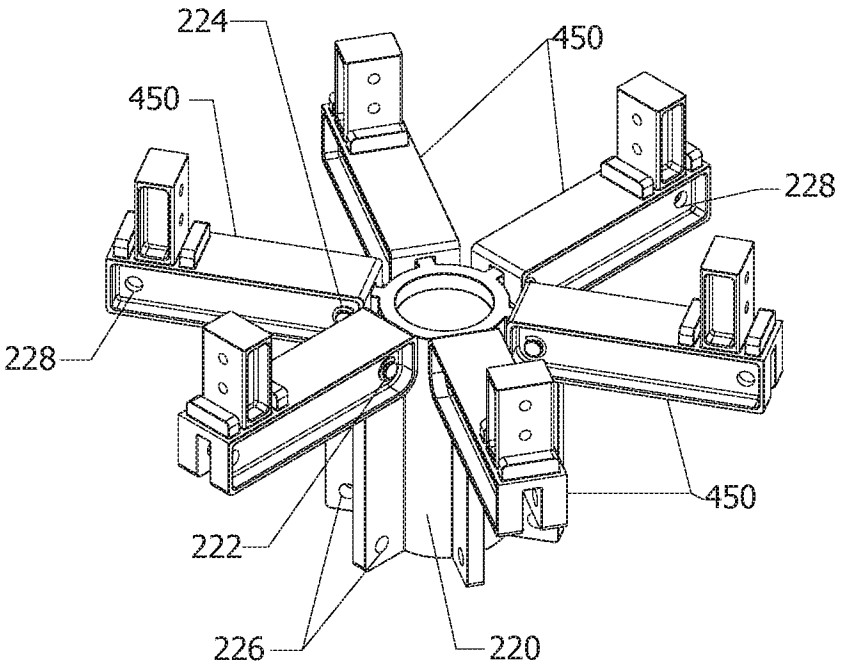
FIG. 17 shows a perspective view of the sliding hub assembly of the internal collapsible frame.

Referring now to FIG. 17, the sliding hub assembly is shown including the sliding hub 220 along with a plurality of sliding hub connectors 450. The sliding hub connectors 450 can be pivotably attached to the sliding hub 220 via pins 222 and pin clips 224. When the internal collapsible frame 140 is in an erected, non-collapsed position, the sliding hub connectors 450 can pivot downwardly allowing the ceiling tube assemblies 400 to extend substantially horizontally. Moreover, after the internal collapsible frame 140 is erected, connector pins can be inserted through holes 228 formed on the sliding hub connectors 450 and through lower thru holes 226 formed on sliding hub 220 to lock the frame 140 in the erected, non-collapsed position.

Figure 18:
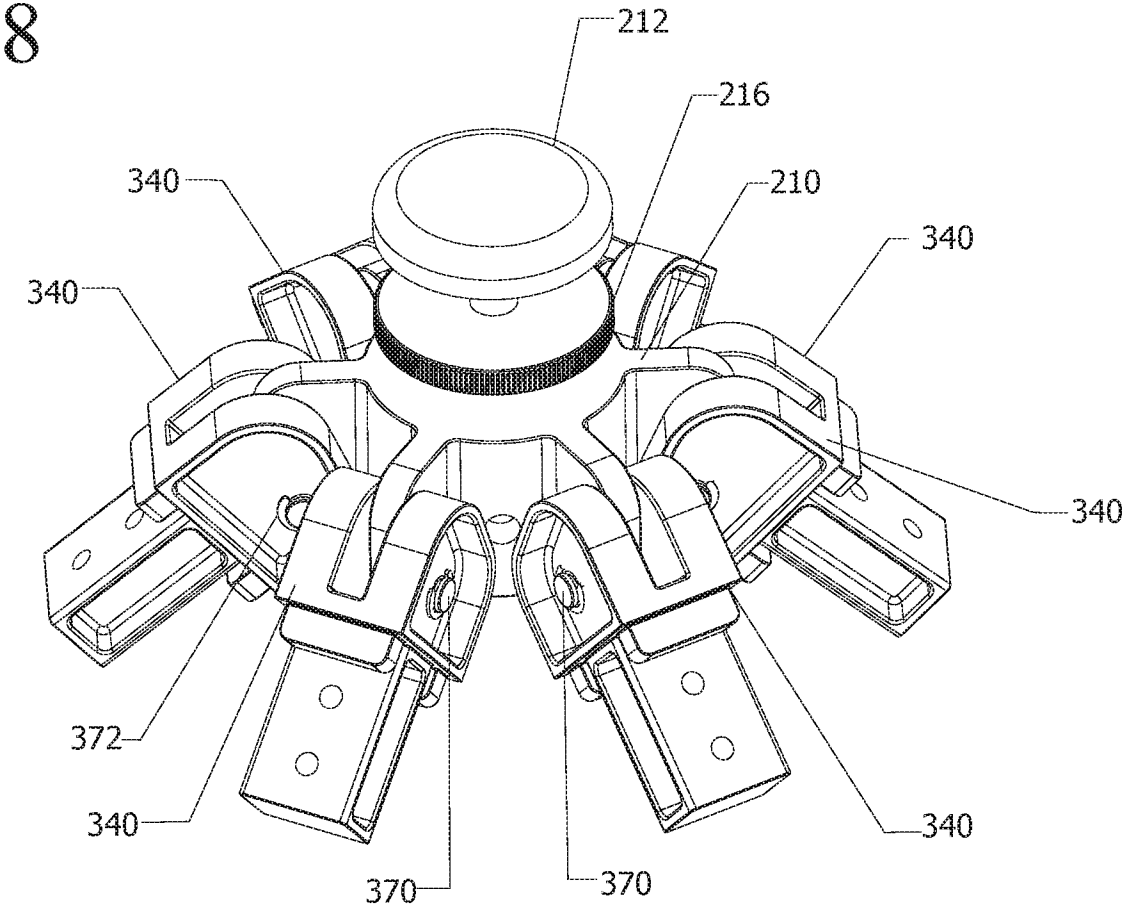
FIG. 18 shows a perspective view of the top hub assembly of the internal collapsible frame.

Referring now to FIG. 18, the top hub assembly is shown including the top hub 210 along with a plurality of top hub connectors 340. The top hub connectors 340 can be pivotably attached to the top hub 210 via pins 370 and pin clips 372. The fabric tensioner 212 can be threaded into the top hub 210 and can be locked in position with the lock nut 216.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. An internal collapsible frame for use with an outdoor living structure comprising:

a center tube assembly including a center tube including a top end portion and a bottom end portion;

a top hub fixably attached to the center tube in the vicinity of the top end thereof;

a slidable hub arranged on the center tube and slidably movable between the top end portion and a bottom end portion;

a plurality of roof tube assemblies each including a first end and a distal second end, each first end being pivotably attached to the top hub; and a plurality of ceiling tube assemblies each including a first end and a second end, each first end being pivotably attached to the slidable hub and each second end being attached to an outer corner connection assembly; and a plurality of hinged strut assemblies each including a first end and a second end and being capable of folding about a hinge, each of the first and second ends of the hinged strut assemblies being attached to a ceiling tube end cap of the outer corner connection assembly;

wherein the distal end of each roof tube assembly is attached via a pivot hinge to a ceiling tube assembly in an area between the first end and the second end of the ceiling tube assembly;

wherein when the internal collapsible frame is being erected by the application of an upward force to the slidable hub, the distance between neighboring outer second ends of the ceiling tube assemblies increases, forcing each of the hinged strut assemblies to unfold until the hinged strut assemblies are all in a straightened state and form a ring around an outer perimeter of the collapsible frame; and wherein when the internal collapsible frame is being erected, the ends of the hinged strut assemblies are configured to i) pivot with respect to a top surface of the ceiling tube end cap, and ii) rotate about a central axis of the hinged strut assembly.

2. The internal collapsible frame of claim 1, wherein the ends of the hinged strut assemblies are configured to pivot up to about 60 degrees and to rotate up to about 30 degrees.

3. The internal collapsible frame of claim 1, wherein when the internal collapsible frame is being collapsed, the roof tube assemblies and ceiling tube assemblies are configured to pivot and the hinged strut assemblies are configured to fold such that the roof tube assemblies, ceiling tube assemblies, and hinged strut assemblies are adapted to each rest in close proximity to the center tube assembly.

4. The internal collapsible frame of claim 1, wherein the second end of each roof tube assembly is attached via a pivot hinge to a ceiling tube assembly at substantially a mid-point of a length of each ceiling tube assembly.

5. The collapsible living structure of claim 4, wherein the distal end of each roof tube assembly is pivotably attached to a ceiling tube assembly at substantially a mid-point of a length of each ceiling tube assembly.

6. The internal collapsible frame of claim 1, further including a plurality of leg tube assemblies each including a first end and a second end, each first end being pivotably attached to the second end of a respective ceiling tube assembly.

7. An internal collapsible frame for use with an outdoor living structure comprising:

a center tube assembly including a center tube including a top end portion and a bottom end portion;

a top hub fixably attached to the center tube in the vicinity of the top end thereof;

a slidable hub arranged on the center tube and slidable movable between the top end portion and a bottom end portion;

a plurality of ceiling tube assemblies each including a first end and a second end, each first end being pivotably attached to the slidable hub and each second end being attached to an outer corner connection assembly;

a plurality of hinged strut assemblies each including a first end and a second end and being capable of folding about a hinge, each of the first and second ends of the hinged strut assemblies being attached to a ceiling tube end cap of the outer corner connection assembly;

wherein when the internal collapsible frame is being erected by the application of an upward force to the slidable hub and causing the distance between neighboring outer second ends of the ceiling tube assemblies to increase, the ends of the hinged strut assemblies are configured to i) pivot with respect to a top surface of the ceiling tube end cap, and ii) rotate about a central axis of the hinged strut assembly.

8. The internal collapsible frame of claim 7, wherein the ends of the hinged strut assemblies are configured to pivot up to about 60 degrees with respect to a top surface of the ceiling tube end cap and to rotate up to about 30 degrees.

9. The internal collapsible frame of claim 7, wherein when the internal collapsible frame is being erected by the application of an upward force to the slidable hub, each of the hinged strut assemblies are forced to unfold until the hinged strut assemblies are all in a straightened state and form a ring around an outer perimeter of the collapsible frame.

10. The internal collapsible frame of claim 7, further including a plurality of roof tube assemblies each including a first end and a distal second end, each first end being pivotably attached to the top hub and each second end being attached via a pivot hinge to a ceiling tube assembly.

11. The internal collapsible frame of claim 10, wherein the distal end of each roof tube assembly is pivotably attached to a ceiling tube assembly at substantially a mid-point of a length of each ceiling tube assembly.

12. The internal collapsible frame of claim 7, wherein when the internal collapsible frame is in a collapsed state, the roof tube assemblies and ceiling tube assemblies pivot and the hinged strut assemblies fold and all rest in close proximity to the center tube assembly.

13. The internal collapsible frame of claim 7, further including a plurality of leg tube assemblies each including a first end and a second end, each first end being pivotably attached to the second end of a respective ceiling tube assembly.

14. A collapsible structure comprising:

an internal collapsible frame;

a fabric roof securable to the internal collapsible frame;

the internal collapsible frame including:

a center tube assembly including a center tube including a top end portion and a bottom end portion;

a top hub fixably attached to the center tube in the vicinity of the top end thereof;

a slidable hub slidably arranged on the center tube;

a plurality of roof tube assemblies each including a first proximal end and a second distal end, each first proximal end being pivotably attached to the top hub;

a plurality of ceiling tube assemblies each including a first proximal end and a second distal end, each first proximal end being pivotably attached to the sliding hub and each second distal end being attached to an outer corner connection assembly; and a plurality of hinged strut assemblies each including a first end and a second end and being capable of folding about a hinge, each of the first and second ends of the hinged strut assemblies being attached to a ceiling tube end cap of a respective outer corner connection assembly and being capable of pivoting and rotating with respect to the ceiling tube end cap.

15. The collapsible structure of claim 14, wherein when the internal collapsible frame is in a collapsed state, the roof tube assemblies and ceiling tube assemblies pivot and the hinged strut assemblies fold and all rest in close proximity to the center tube assembly.

16. The collapsible structure of claim 14, wherein when the internal collapsible frame is in an erected state, the plurality of hinged strut assemblies unfold and form a ring around an entire outer perimeter of the internal collapsible frame.

17. The collapsible structure of claim 14, wherein the distal end of each roof tube assembly is attached via a pivot hinge to a ceiling tube assembly in a manner such that when an upward force is applied to the sliding hub, the ceiling tube assemblies apply a load to the roof tube assemblies via the pivot hinge and force the ceiling tube assemblies and roof tube assemblies to extend radially outwardly from the center tube assembly.

18. The collapsible structure of claim 17, wherein the distal end of each roof tube assembly is pivotably attached to a ceiling tube assembly at substantially a mid-point of a length of each ceiling tube assembly.

19. The collapsible structure of claim 14, further comprising a plurality of leg tube assemblies each pivotably connected to the second distal end of a respective ceiling tube assembly.

* * * * *